US005363513A

United States Patent [19]

Blankenburg

[11] Patent Number: 5,363,513

[45] Date of Patent: Nov. 15, 1994

[54] PRESSURIZED FLUSHING TOILET

[76] Inventor: Karl Blankenburg, 32131 Claeys Dr., Warren, Mich. 48093

[21] Appl. No.: 125,106

[22] Filed: Sep. 22, 1993

[51] Int. Cl.[5] ..... E03D 3/10

[52] U.S. Cl. ..... 4/354; 4/361; 4/362

[58] Field of Search ..... 4/332, 354, 355, 356, 4/357, 358, 359, 360, 361, 362; 141/67; 222/61, 63, 64

[56] References Cited

U.S. PATENT DOCUMENTS

| | | | |
|---|---|---|---|
| 1,231,828 | 7/1917 | West et al. | 4/359 |
| 2,966,044 | 12/1960 | Mitchell . | |
| 3,052,377 | 9/1962 | Bill | 222/61 |
| 3,555,571 | 1/1971 | Gibbs et al. . | |
| 3,605,125 | 9/1971 | Gibbs et al. . | |
| 3,613,954 | 10/1971 | Boyne | 222/61 |
| 3,621,495 | 11/1971 | Carson | 4/360 |
| 3,628,195 | 12/1971 | Skousgaard | 4/354 |
| 3,792,497 | 2/1975 | Robbins | 4/354 |
| 3,813,701 | 6/1974 | Stevens | 4/362 |
| 3,817,286 | 6/1974 | Caron et al. . | |
| 3,817,489 | 6/1974 | Caron et al. . | |
| 3,820,171 | 6/1974 | Larson . | |
| 3,820,754 | 6/1974 | Caron et al. . | |
| 4,060,857 | 12/1977 | Couton . | |
| 4,106,136 | 8/1978 | Lippincott, Sr. . | |
| 4,140,245 | 2/1979 | Castillo | 222/64 |
| 4,142,262 | 3/1979 | Hamilton . | |
| 4,143,433 | 3/1979 | Skousgaard . | |
| 4,152,793 | 5/1979 | Mills . | |
| 4,170,048 | 10/1979 | Anthony . | |
| 4,183,108 | 1/1980 | Hamilton . | |
| 4,232,409 | 11/1980 | Van Pham . | |
| 4,233,698 | 11/1980 | Martin . | |
| 4,407,025 | 10/1983 | Hennessy et al. | 4/354 |
| 4,510,629 | 4/1985 | Jovy et al. | 4/332 |
| 4,584,726 | 4/1986 | Grills et al. . | |
| 4,676,404 | 6/1987 | Yamazaki et al. | 222/61 |
| 4,707,868 | 11/1987 | Hennessy . | |
| 4,858,638 | 8/1989 | Cseri . | |
| 4,955,921 | 9/1990 | Basile et al. . | |
| 4,965,892 | 10/1990 | McDonough . | |
| 4,984,311 | 1/1991 | Basile et al. . | |
| 4,999,859 | 3/1991 | Bolze et al. . | |
| 5,005,226 | 4/1991 | Basile et al. . | |
| 5,046,201 | 9/1991 | Steinhardt et al. . | |
| 5,067,180 | 11/1991 | Figeroid . | |
| 5,115,521 | 5/1992 | Adamides . | |
| 5,136,732 | 8/1992 | Andersson . | |

FOREIGN PATENT DOCUMENTS

| | | | |
|---|---|---|---|
| 356980 | 12/1905 | France | 4/354 |
| 2634248 | 2/1978 | Germany | 4/354 |
| 1754 | of 1868 | United Kingdom | 4/354 |
| 499213 | 1/1939 | United Kingdom | 4/362 |

*Primary Examiner*—Henry J. Recla
*Assistant Examiner*—Charles R. Eloshway
*Attorney, Agent, or Firm*—Basile and Hanlon

[57] ABSTRACT

A pressurizable flushing toilet includes a pressurizable water container having a movable stopper closing a water discharge outlet in the container. A controller energizes a solenoid to move the stopper between an outlet closing position and an outlet opening position. A water level sensor is mounted in the container and supplies a signal to the controller indicative of the build-up of a predetermined level of water within the container. The controller activates a compressor to pressurize air in the container above the water to a predetermined pressure level. A pressure sensor is mounted in the container and generates an output signal when a predetermined pressure level is reached within the container.

38 Claims, 4 Drawing Sheets

PRESSURIZED FLUSHING TOILET

BACKGROUND OF THE INVENTION

1. Field of the Invention

The present invention relates, in general, to toilets and, more specifically, to pressurized flushing toilets.

2. State of the Art

Gravity type flush toilets or commodes are widely used. A gravity type flush toilet utilizes the gravity flow of water stored in a tank connected in fluid flow communication with a toilet bowl to provide the necessary amount of water to flush and cleanse the bowl. Such toilets use approximately 3 ½ to 7 gallons of water per flush to ensure adequate cleansing of the toilet bowl.

Due to conservation concerns, low volume toilets have been designed which use less water per flush, typically one to two gallons. However, unless specific modifications are made to the toilet, such low volumes of water may not be sufficient to provide a complete flushing or cleansing action of the toilet bowl. Thus, pressurized low volume flushing systems have been devised which utilize pressurized air above the water in the tank to forcibly discharge the water from the tank into the toilet bowl.

Such pressurized toilet flushing systems utilize incoming water line pressure to provide the necessary air pressure buildup within the tank. The water line pressure also determines the amount of time required to fill the tank between flush cycles. In situations where the incoming water line pressure drops temporarily below a normal pressure level for long lengths of time or is generally not present at a sufficiently high pressure, the performance of such pressurized flushing toilet systems dramatically decreases since the low water line pressure requires additional time to fill the toilet bowl to the required level for the next flush cycle as well as to buildup the required amount of air pressure within the tank. If the water pressure is low enough, such pressurized systems may prove to be totally ineffective in obtaining the desired air pressure level required for a complete pressurized flush cycle.

Thus, it would be desirable to provide an improved pressurized flush toilet which overcomes the deficiencies of previously devised pressurized flush toilets. It would also be desirable to provide a pressurized flush toilet which provides a desired amount of air pressure above the water in the tank regardless of the incoming water line pressure. It would also be desirable to provide a pressurized flush toilet which provides the desired amount of air pressure above the water in the tank in a short amount of time.

SUMMARY OF THE INVENTION

The present invention is a pressurized flushing toilet which provides a consistent air pressure above the water in a tank regardless of the incoming water line pressure.

The pressurized flushing toilet includes a closed, pressurizable container connected in fluid flow communication with a toilet bowl and having an interior chamber with a water inlet and a water outlet. A stopper means is mounted in the interior chamber for releasably closing the water outlet in the container. Means are connected to the stopper means for moving the stopper means between a first position closing the water outlet and a second position spaced from and opening the water outlet for the flow of water from the container to a toilet bowl. Vent means are mounted on the container for venting the interior chamber of the container to atmosphere. Means are connected to a water delivery conduit and the water inlet on the container for selectively delivering water into the interior chamber within the container. Means are disposed in communication with the interior chamber of the container for pressurizing the air in the chamber above the water in the interior chamber. A control means controls the stopper moving means, the venting means and the pressurizing means in a timed sequence to fill the container with water, to pressurize the air above the water in the interior chamber to a predetermined pressure level and to discharge water through the water outlet of the container to the toilet bowl under pressure.

The water delivery means comprises a solenoid operated, two port valve, with one closable port being connected to the water inlet conduit and the interior chamber and another closable port being connected between the interior chamber and atmosphere. A pressure relief means is mounted on the container in communication with the interior chamber thereof for releasing pressure from the container at a predetermined pressure level.

The stopper moving means preferably comprises an electrically operated solenoid having a movable plunger connected to the stopper means. The stopper means is in the form of flexible member connected at one end to the solenoid plunger and at another end to a resilient generally spherical member mounted sized to engage and close the water outlet of the container.

The control means preferably comprises a microprocessor operating a stored control program. The microprocessor receives inputs from a flush start button, a water level sensor switch mounted within the interior chamber of the container and a pressure switch mounted to sense the interior chamber pressure. Based on these inputs, the control means after determining that a predetermined amount of water is stored within the container and that a predetermined air pressure has been built up above the water in the container, upon pressing of the flush start button, activates the solenoid to disengage the stopper from the water outlet so as to permit water under pressure to be discharged through the water outlet of the container into the toilet bowl.

After the water has been discharged from the interior chamber, the control means deactivates the solenoid to enable the stopper to move by gravity into closing engagement with the water outlet. The control means also energizes the water delivery valve to allow water to flow from the water inlet conduit into the interior chamber of the container and simultaneously to allow water to flow through the bleed line into the toilet bowl to fill the toilet trap. The valve simultaneously vents the interior chamber to atmosphere to relieve any pressure during the flow of water to the interior chamber of the container.

After a predetermined amount of water has been stored within the container, as indicated by the water level sensor switch, the control means closes the valve to cease further water flow to the container. The valve also closes the vent port. At this time, the control means activates the pressurizing means, preferably an air compressor, which, through a separate inlet to the interior chamber of the container, pressurizes the air in the interior chamber of the container above the water level to a predetermined pressure level. When the predetermined pressure level has been reached, as indicated by an output from a pressure sensor switch, the control means deenergizes the compressor to place the toilet in a ready condition for the next flush cycle.

The pressurized flushing toilet of the present invention uniquely provides a pressurized flow of water from a container at a predetermined pressure level regardless of the pressure of the incoming water line to the container. By unique use of an air compressor, the toilet of the present invention provides the desired pressurized water discharge from the container despite any low water inlet pressure. This unique arrangement not only provides the desired air pressure level, but, further, provides the desired pressure level in a quick manner so as to permit quick flush cycles.

The toilet of the present invention overcomes deficiencies encountered with previously devised toilets and, in particular, pressurized toilets which take a considerable amount of time to refill the tank with water and to build up the desired air pressure above the tank if the incoming water line pressure is below a normal pressure level.

The pressurized flushing toilet of the present invention may be a stand-alone unit with the tank and pressurizable container integrally formed as a unitary assembly or provided as an retrofit or insert into an existing or new toilet tank.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENT

Figure 1:
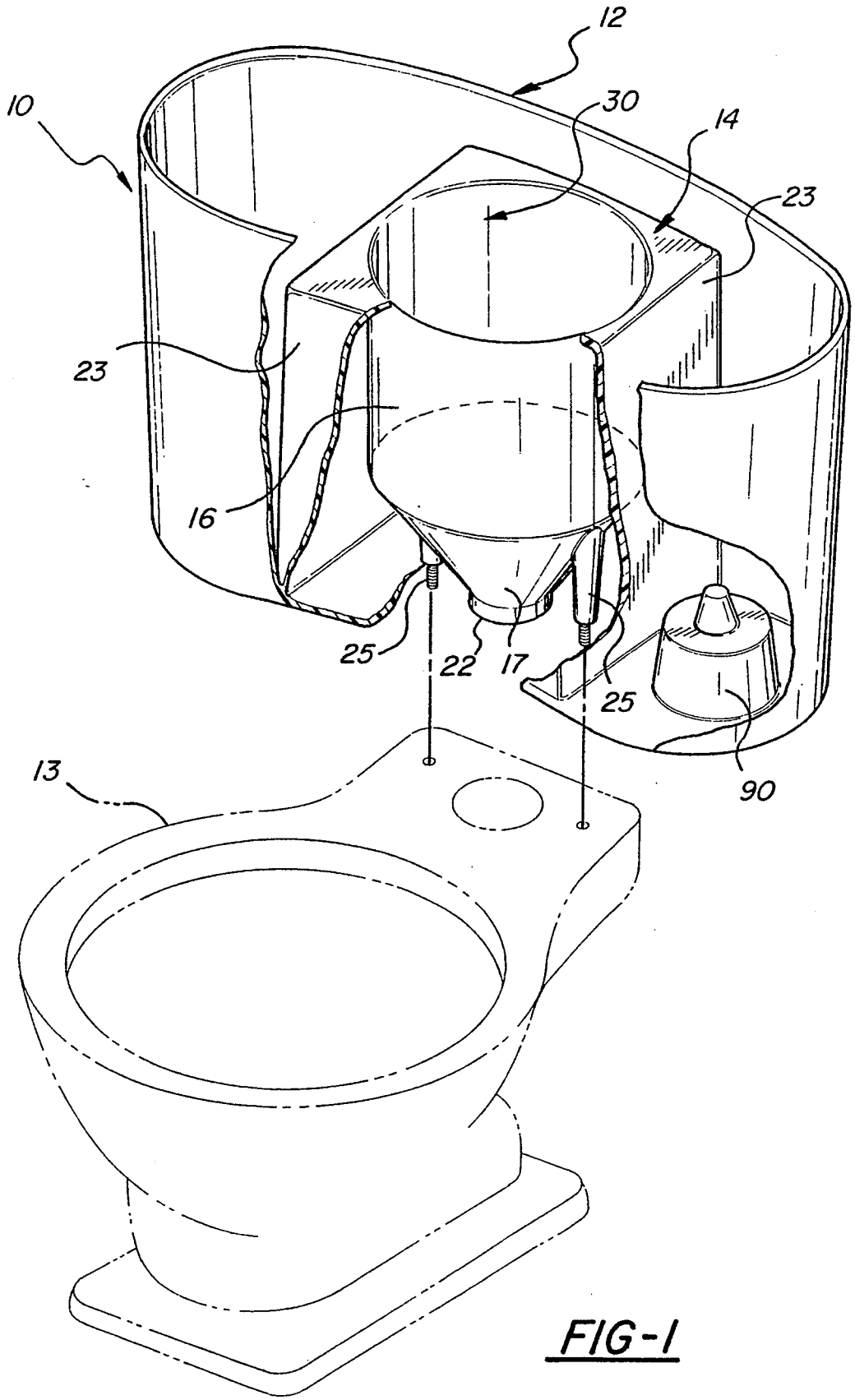
FIG. 1 is a partially broken away, perspective view of the pressurized flushing toilet of the present invention, which certain elements not depicted for clarity.

Referring now to the drawing, and to FIGS. 1–4 in particular, there is depicted a pressurized flushing toilet 10 constructed in accordance with the teachings of the present invention.

Figure 2:
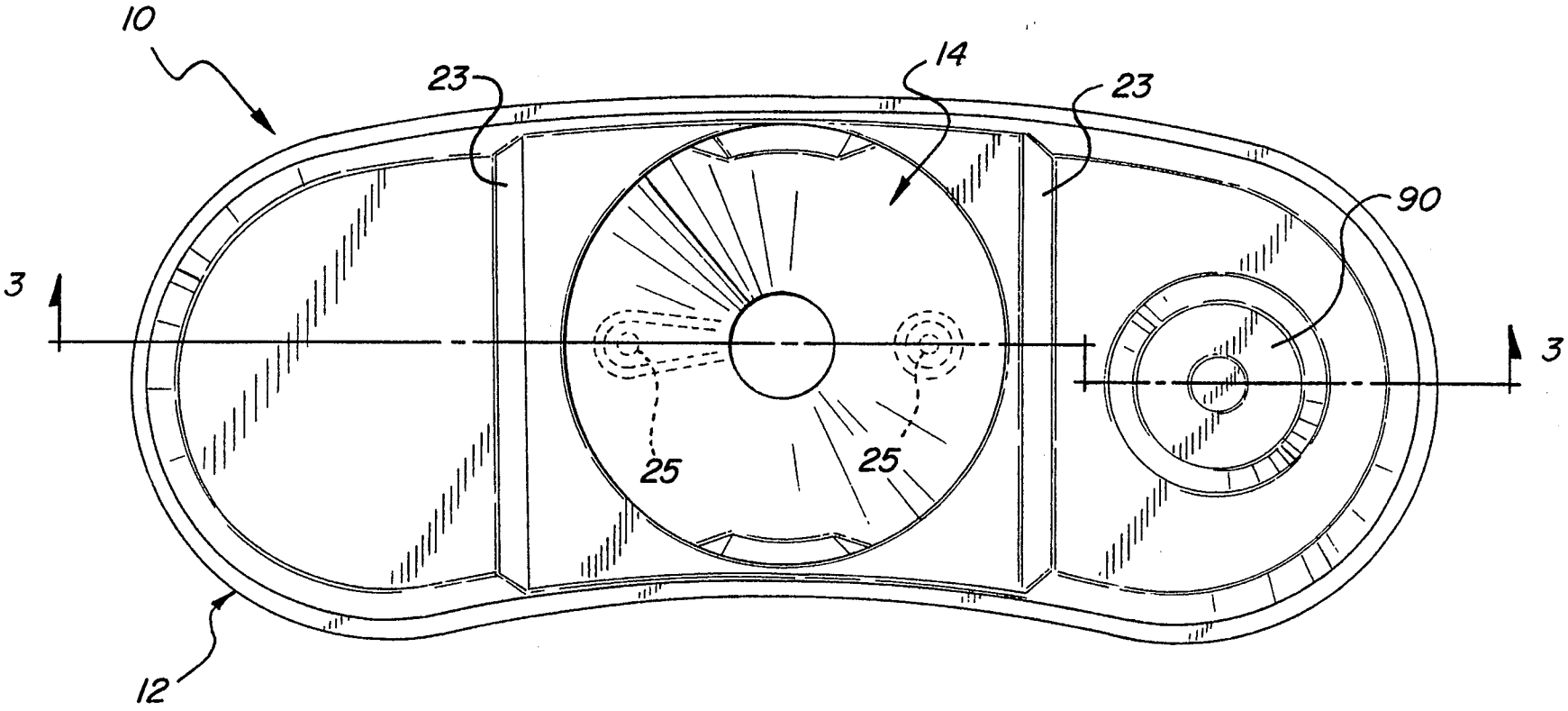
FIG. 2 is a plan view of the pressurized flushing toilet shown in FIG. 1.
Figure 3:
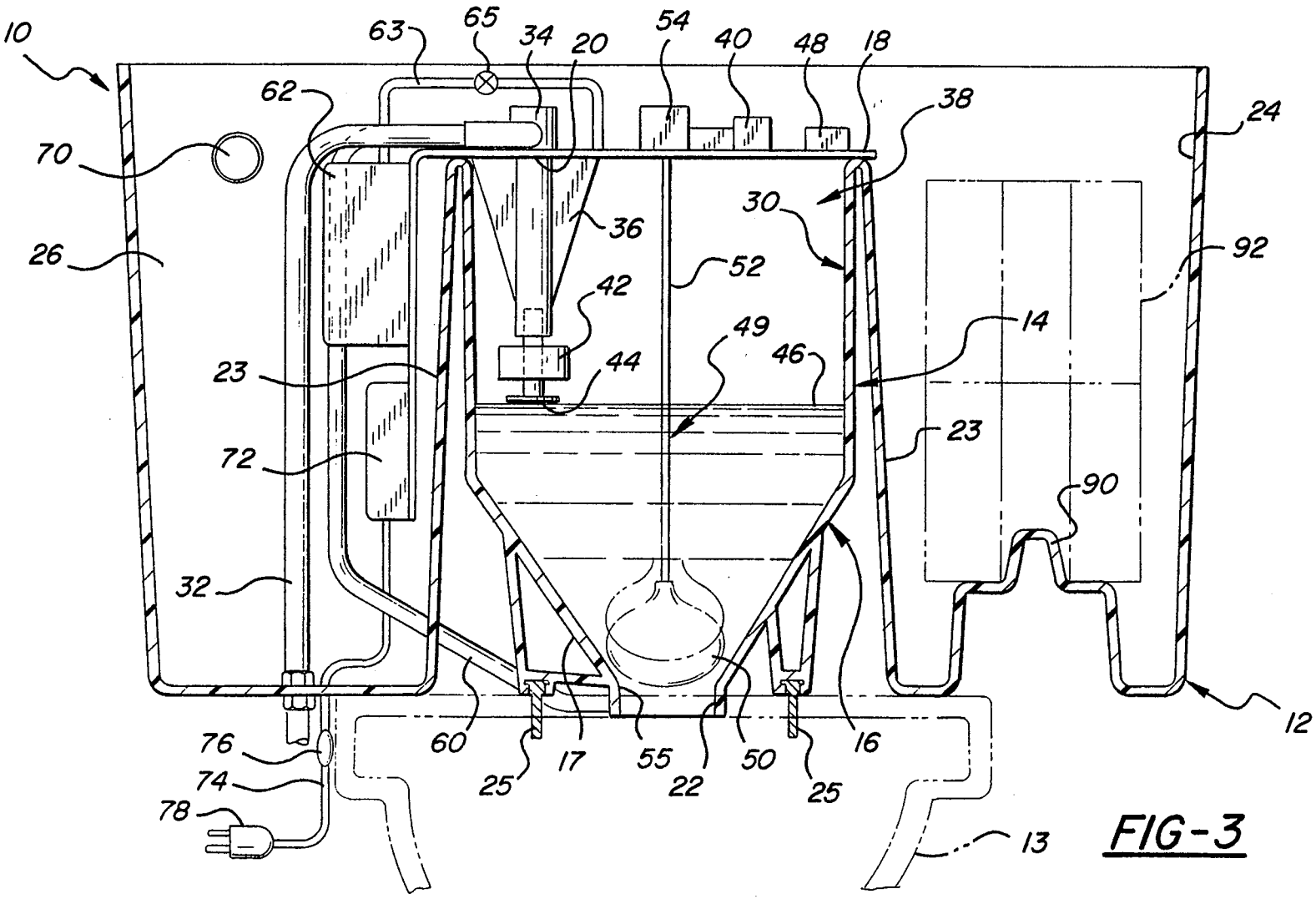
FIG. 3 is a cross sectional view generally taken along line 3—3 in FIG. 3 and showing the pressurized flushing toilet of the present invention in a filled, pressurized state.

As shown in FIGS. 1–3, the toilet 10 includes a tank 12 which is disposed in fluid flow communication with a toilet bowl 13. The tank 12 may have any desired shape, such as the illustrated smoothly curved, generally oval shape. A top, not shown, may be provided for removably closing the open top end of the tank 12. In a preferred embodiment, the tank 12 is provided with an internally mounted, sealed, hollow, generally circular cross section, cylindrical pressurizable container 14. The container 14 is formed with side wall 16, a top 18 sealingly attached to an upper portion of the side wall 16, a water flow inlet 20 preferably extending through the top 18 and a water outlet 22 formed at a converging funnel shaped lower end of the side wall 16.

The tank 12 and pressurizable container 14 may be designed as a single unitary stand-alone unit. Alternately, the tank 12 may comprise an existing toilet tank with the container 14 provided as a separate retrofit unit mountable in the tank.

By way of example only, the tank 12 is formed with two side compartments 24 and 26 which are not sealed and which are disposed on opposite sides of the pressurizable, sealed container 14. As shown in FIG. 3, interior walls 23 are formed on the tank and merge unitarily with the side wall 16 of the container 14. The tank 12 and container 14 may be formed of any suitable material, such as ceramic or porcelin, although a high strength plastic is preferred. A pair of depending legs 25 are formed with and extend from the converging lower end 17 of the side wall 16 of the container for attachment to the toilet bowl 13 in a conventional manner.

The tank 12, container 14 and the walls 23 are preferably integrally molded as a one piece unit. However, separate elements suitably joined together can also be used to form the toilet 10.

Means are provided for delivering water to an interior chamber 30 formed within the container 14. The water delivery means includes a water delivery conduit 3 which is connected to a suitable source of pressurized water in a building, residential home, etc. The conduit 32 extends through the side compartment 26 to a means for controlling the flow of water to the interior chamber 30 in the container 14. The water flow controlling means 34 preferably comprises a two port, solenoid operated valve which is mounted on the top 18 of the container 14. The valve 34 may be a double solenoid operated valve or, as shown by way of example only in FIG. 4, a single solenoid spring return valve which is switchable between two positions. In a first flush ready position, a first inlet 33 of the valve 34 connected to the water delivery conduit 32 blocks the flow of water to the interior chamber 30 of the container 14. A first outlet 35 of the valve 34 is connected to a hollow water level sensor float switch support 36 or pedestal and is disposed in fluid flow communication with the interior chamber 30. A second inlet port 37 on the valve 34 is open to atmosphere within the tank 12, but is blocked from air flow when the valve 34 is in the first position. A second outlet 39 of the valve 34 is connected to a pressurizable upper portion 38 of the interior chamber 30 of the container 14.

When the valve 34 is shifted to a second position, as described hereafter, the first inlet 33 and first outlet 35 are disposed in fluid flow communication to allow the flow of water from the delivery conduit 32 to the interior chamber 30. At the same time, the second inlet 37 and second outlet 39 are connected in fluid flow communication to vent the interior chamber 30 to atmosphere while water is flowing into the container 14.

Pressure relief means 40 is also mounted on the top 18 of the container 14. The pressure relief means 40 comprises a conventional pressure relief valve disposed in communication with the upper pressurizable portion 38 of the interior chamber 30 and is operable to vent the interior chamber 30 to atmosphere if the pressure within the upper pressurizable portion 38 of the container 30 exceeds a predetermined level. The pressure relief valve may be any conventional pressure relief valve which is settable to any pressure level, such as, for example, 16 psi. If the pressure within the container 30 exceeds the set pressure level, the pressure relief valve 40 opens to vent the air pressure to atmosphere so as to prevent an excessive build-up of pressure within the container 14.

A water level sensor means 42 is mounted within the interior chamber 30 on the pedestal 36 which extends from the bottom of and is formed as part of the top 18. The water level sensor means 42 detects a predetermined level of water within the container 14. The water level sensor means 42 may preferably comprise a conventional float switch having a movable actuator 44 which moves upon engagement with the top surface 46 of water within the container 14. Such movement of the actuator 44 causes the water level sensor means 42 to generate an electrical output signal, the purpose of which will be described in greater detail hereafter.

Also mounted on the top 18 of the container 14 is a pressure sensing means 48 which senses the pressure within the pressurizable portion 38 of the interior chamber 30. The pressure sensing means 48 may comprise a conventional pressure switch which provides an electrical output signal when a predetermined pressure i.e., 12–14 psi, has been attained within the pressurizable portion 38 of the interior chamber 30.

Stopper means 49 are also provided for releasably closing the water outlet 22 of the container 14. The stopper means 49 preferably comprises a resilient or deformable stopper or plunger 50 formed of rubber or similar material and having a generally spherical shape sized to engage and completely close off the water outlet 2 in the container 14 when in a first position. The stopper 50 is connected to one end of a flexible member 52, such as a flexible tube, chain, etc.

The other end of the flexible member 52 is connected to a stopper moving means denoted generally by reference number 54. The stopper moving means 54 preferably comprises an electrically operated solenoid having a plunger which moves to a first position when the solenoid is energized and which moves or retracts to an opposite, second position when the solenoid is deenergized. Also encompassed within the teaching of the solenoid is a double electrically operated solenoid requiring separate activation signals for each movement of the plunger between the first and second positions. When in a first position, the plunger of the solenoid 54 advances causing the flexible member 52 attached thereto to fully extend and allow the stopper 50 to move into sealing engagement with a throat section 55 formed at the end of the converging portion 17 of the side wall 16 of the container 14 adjacent to the water outlet 22 thereby closing off the water outlet 22 to further water flow from the interior chamber 30 of the container 14 to the toilet bowl 13. Movement of the plunger of the solenoid 54 in the opposite direction to the second position causes the flexible member 52 to retract the stopper 50 from engagement with the throat section 55 of the container as shown in phantom in FIG. 3. This opens the water outlet 22 to the flow or discharge of water from the interior chamber 30 of the container 14 to the adjacent toilet bowl 13.

A water bleed line conduit 60 extends from the valve 34 to the water outlet 22 bypassing the pressurized container 14. The water bleed line conduit 60 provides a secondary water flow path from the water inlet conduit 32 to the toilet bowl 13 below the stopper 50 to provide a sufficient amount of water to fill the trap of the toilet bowl 13 while the container 14 is being refilled with a predetermined quantity of water for the next flush cycle. The water bleed line conduit 60 may be regulated with a mechanical cutoff flow screw, not shown, at its port connection to the first outlet 35 on the solenoid valve 34 to provide a variably selectible amount of water to the toilet trap.

Figure 4:
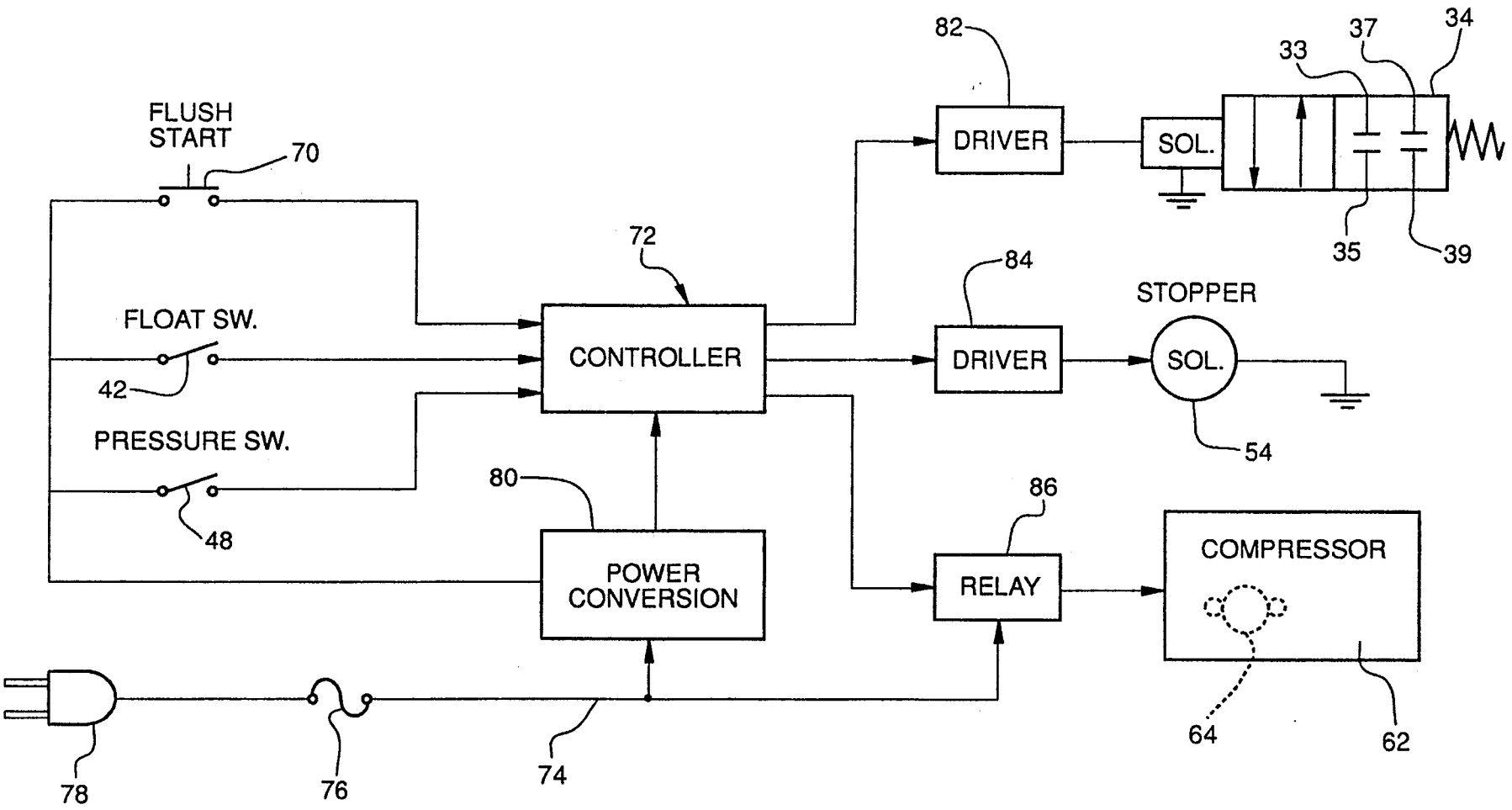
FIG. 4 is a schematic diagram of the control means used in the pressurized flushing toilet shown in FIG. 1.

Means are also provided for pressurizing the pressurizable portion 38 of the interior chamber 30 of the container 14. The pressurizing means preferably comprises an electrically operated air compressor 62 mounted on an extension of the top 18 of the container 14 as shown in FIG. 3. Any conventional electrically operated compressor 62 may be used in the toilet 10 which is capable of pressurizing the container 14 to a set pressure, i.e. 12–14 psi. Such compressors include a motor 64, as shown in FIG. 4, which drives a pump to compress air drawn into the compressor 62 through an inlet, not shown, and to supply the pressurized air to the interior chamber 30 of the container 14. The compressor 62 has an outlet which is connected to one end of a conduit 63. The other end of the conduit 63 is mounted on the top 18 and disposed in fluid flow communication with the upper portion of the interior chamber 30 of the container 14. A one way check valve 65 is mounted in the conduit 63 to prevent pressurized air on the interior chamber 30 from venting back through the compressor 62.

A flush start button or switch denoted generally by reference number 70 is mounted on the tank 12 and is accessible exteriorly of the tank 12. The flush start button 70 may be any conventional electric push button or switch which provides an electrical output signal when depressed.

The toilet 10 also includes a control means or controller denoted generally by reference number 72 which receives input signals from the flush start button 70, the pressure sensing switch 48 and the water level sensor 42. The controller 72 controls by suitable output signals the position of the stopper 50 via the solenoid 54, the subsequent pressurized discharge of the water from the container 14 through the outlet 22 to the toilet bowl 13, a re-filling of the container 14 with water via valve 49, and the activation and de-activation of the air compressor 62 to pressurize the upper portion 38 of interior chamber 30 of the container 14 above the water to a predetermined pressure level.

The controller 72 may comprise any conventional electronic circuit designed to affect the desired sequence described hereafter. By way of example only, in a preferred embodiment, the controller 72 comprises a conventional microprocessor which executes a stored control program in response to various inputs and controls various outputs as described hereafter. The controller 72 may be mounted on an extension of the top 18 of the container 14 and disposed within the side compartment 26 of the tank 12.

The controller 72 is supplied with electrical power from a suitable electrical power source. By way of example only, a conductor 74 having a fuse 76 mounted therein is connected by means of a conventional plug 78 to a source of 110-120 VAC power, such as that provided by a conventional electric outlet in a building or home. Alternately, electric power may be supplied to the controller 72 by an internal power supply, such as batteries, not shown, mounted within the side compartment 26.

As shown in FIG. 4, a power conversion circuit 80 receives the input 110-120 VAC electrical power and converts such power to the low level DC voltage required by the controller 72 and the electronic devices driven by the controller 72. Electric power is also provided to the flush start button 70, the water level sensor 42 and the pressure switch 48.

Suitable drivers 82 and 84, which may comprise solid state relays, power transistors, etc., are connected to certain outputs of the controller 72 to drive the solenoid valve 34 and the solenoid 54. A separate relay 86 connected to the incoming AC power line conductor 74 may be actuated by an output from the controller 72 to drive the motor 64 in the compressor 62, as described hereafter.

In order to describe the sequence of operation of the pressurized flushing toilet 10 of the present invention, it will be assumed that a predetermined level of water, as denoted by reference number 46 in FIG. 3, is contained within the container 14 and that a predetermined pressure, such as 12 to 14 psi, has been built up in the pressurized portion 38 of the interior chamber 30 above the water surface 46. Further, the stopper 50 is in a position closing the water outlet 22. In this state, the pressurized flushing toilet 10 is in a state ready for flushing.

To initiate a flush cycle, the flush start push button 70 is depressed. This generates an electric signal which is input to the controller 72. In response thereto, the controller 72 activates the stopper solenoid 54 to retract the stopper 50 from the water outlet 22 in the container 14 thereby opening the water outlet 22 of the container 14 for the pressurized discharge of water from the container 14 to the toilet bowl 13.

After all of the water in the container 14 has been discharged from the container 14, the controller 72 deactivates the solenoid 54 causing the flexible member 52 to allow the stopper 50 to move into secure engagement with and closing the water outlet 22. This signal to close the water outlet 22 could be provided on a timed basis via an internal timer in the controller 72 or by a signal from the pressure switch 48 indicating a zero pressure within the interior chamber 30 or the lack of a signal from the water level sensor 42. After the stopper 50 has closed the water outlet 22, the controller 72 sends a signal to the valve 34 to switch the valve 34 to a position connecting the water inlet conduit 32 in fluid flow communication with the interior chamber 30 in the container 14 to supply water to the container 14. At the same time, second inlet and outlet ports 37 and 39 of the valve 34 are connected to atmosphere to vent the upper portion 38 of the container 30 to atmosphere so as to permit the easy flow of water into the interior chamber 30 of the container 14. At the same time, a small amount of water flows from the first outlet 35 through the water bleed line conduit 60 to fill the trap in the toilet bowl 13.

When the water in the container 14 reaches a predetermined level denoted by reference number 46, the surface 46 of the water will act on the actuator 44 of the water level sensor means 42. The sensor 42 then generates an output signal to the controller 72. The controller 72 in turn, activates the solenoid valve 34 to switch the ports of the valve 34 to a position closing the vent ports and, also, blocking the flow path from the water delivery conduit 32 to the interior chamber 30 to stop the further flow of water through the conduit 32 into the interior chamber 30 and through the conduit 60 into the toilet trap. After the valve 34 has sealed the vent ports 37 and 39, the controller 72 generates an output signal to the compressor 62 which supplies compressed air to the upper portion 38 of the interior chamber 30 of the container 14 to raise the pressure of the air in the upper portion 38 to a predetermined level, such as 12 to 14 psi. The pressure switch 48 detects the desired pressure of 12 to 14 psi and generates an output signal to the controller 72 which then de-activates the air compressor 62. In this state, the toilet 10 is again in a charged or ready to flush state.

If for some reason the air compressor 62 remains energized after the desired pressure has been attained within the upper portion 38 of the interior chamber 30, the pressure relieve valve 40 will open the interior compartment 38 to atmosphere to prevent over pressurization of the container 14.

As an optional feature, a tapered support post 90 is formed in and extends upward from the bottom of the side compartment 24 of the tank 12. The post 90 fits within and support one or more rolls of toilet paper 92.

In summary, there has been disclosed a unique pressurized flushing toilet which ensures a predetermined pressurization of air above water stored in a container regardless of the incoming water line pressure. This pressurization is achieved quickly and consistently to ensure proper operation of the toilet when desired.

What is claimed is:

1. A pressurized water container apparatus for a toilet connectible to a water delivery conduit, the toilet including a toilet bowl having a water inlet and a water outlet, the pressurized container apparatus comprising:

a closed pressurizable container having an interior chamber with a water inlet and a water outlet connectible in fluid flow communication with a water inlet of a toilet bowl;

stopper means for releasably closing the water outlet in the container;

means, connected to the stopper means, for moving the stopper means between a first position closing the water outlet and a second position opening the water outlet for the flow of water through the water outlet to the toilet bowl;

means, connected to the water delivery conduit and the water inlet of the container, for selectively delivering water to the interior chamber in the container;

an air compressor, disposed in communication with the interior chamber of the container, for supplying compressed air to the interior chamber above water in the interior chamber to pressurize the container; and electric control means for controlling the stopper moving means and the air compressor to fill the interior chamber with water, to pressurize the container to a predetermined pressure level and to discharge the water under pressure through the water outlet to a toilet bowl.

2. The pressurized container apparatus of claim 1 wherein the means for delivering water comprises:

a solenoid operated valve having a plurality of pairs of ports, a first pair of ports being connected to the water delivery conduit and the interior chamber of the container and a second pair of ports connected between the interior chamber of the container and atmosphere;

the valve including a plunger movable between a first and a second position, the plunger, when in the first position, blocking fluid flow through the first and second pair of ports and, when in a second position, disposing the first pair of ports in fluid flow communication between the water delivery conduit and the interior chamber of the container for the flow of water into the interior chamber and disposing the second pair of ports in fluid flow communication between the interior chamber and atmosphere for venting the interior chamber.

3. The pressurized container apparatus of claim 1 further comprising:

pressure relief means, mounted in communication with the interior chamber of the container, for relieving pressure within the interior chamber at a predetermined pressure within the interior chamber.

4. The pressurized container apparatus of claim 1 wherein the stopper moving means comprises:

an electrically operable solenoid having a movable plunger;

a stopper sized to sealingly close the water outlet in the container; and a flexible member connected to the stopper and the plunger of the solenoid.

5. The pressurized container apparatus of claim 1 wherein the control means comprises a microprocessor operating a stored control program.

6. The pressurized container apparatus of claim 1 further comprising:

water level sensor means, mounted in the interior chamber of the container, for detecting a predetermined level of water in the interior chamber.

7. The pressurized container apparatus of claim 1 further comprising means for sensing the pressure within the interior chamber of the container, the pressure sensing means supplying an output signal to the control means upon detecting a predetermined pressure within the interior chamber.

8. The pressurized container apparatus of claim 1 wherein:

the pressurizable container includes a side wall having first and second ends, the first end surrounding an open top end of the container, a top sealingly closing the open top end of the container, the side wall converging at the second end into a narrow throat portion forming the water outlet.

9. The pressurized container apparatus of claim 1 further comprising:

a hollow tank mountable on a pressurized container apparatus bowl, the pressurizable container adapted to be mounted in the tank.

10. The pressurized container apparatus of claim 1 further comprising:

a water trap disposed near a lower end of and connected to a toilet bowl; and a conduit adapted to be connected in fluid flow communication between the means for delivering water and the water trap for supplying water to the trap.

11. A pressurized water container apparatus for a toilet connectible to a water delivery conduit, the toilet including a toilet bowl having a water inlet and a water outlet, the apparatus comprising:

a hollow tank mountable on a toilet bowl;

a closed pressurizable container having an interior chamber with a water inlet, and a water outlet connectible in fluid flow communication with the water inlet of the toilet bowl;

the pressurizable container being mounted in and integrally formed with the tank as a one piece unitary member;

stopper means for releasably closing the water outlet in the container;

means, connected to the stopper means, for moving the stopper means between a first position closing the water outlet and a second position opening the water outlet for the flow of water through the water outlet to the toilet bowl;

means, connected to the water delivery conduit and the water inlet of the container, for selectively delivering water to the interior chamber in the container;

means, disposed in communication with the interior chamber of the container, for pressurizing air in the interior chamber above water in the interior chamber; and electric control means for controlling the stopper moving means and the pressurizing means to fill the interior chamber with water, to pressurize the air above the water to a predetermined pressure level and to discharge the water under pressure through the water outlet to a toilet bowl.

12. The pressurized container apparatus of claim 11 wherein the tank and the pressurizable container are formed of a molded plastic.

13. The pressurized container apparatus of claim 11 wherein:

the tank has a closable top, exterior side walls, a bottom wall contiguous with the exterior side walls, and an interior wall portion; and the container includes a side wall converging at a lower end portion into a narrow throat section forming the water outlet;

the interior wall of the tank and the side wall of the container being formed as continuous unitary members.

14. A pressurized water container apparatus for a toilet connectible to a water delivery conduit, the toilet including a toilet bowl having a water inlet and a water outlet, the pressurized container apparatus comprising:

a closed pressurizable container having an interior chamber with a water inlet and a water outlet connectible in fluid flow communication with a water inlet of a toilet bowl;

stopper means for releasably closing the water outlet in the container;

means, connected to the stopper means, for moving the stopper means between a first position closing the water outlet and a second position opening the water outlet for the flow of water through the water outlet to the toilet bowl;

means, connected to a water delivery conduit and the water inlet of the container, for selectively delivering water to the interior chamber in the container;

water level sensor means, mounted in the interior chamber of the container, for detecting a predetermined level of water in the interior chamber;

means for sensing the pressure within the interior chamber of the container, the pressure sensing means generating an output signal upon detecting a predetermined pressure within the interior chamber;

flush start means, accessible exteriorly of the container, for generating a flush start signal when actuated;

an air compressor, disposed in communication with the interior chamber of the container, for supplying compressed air to the interior chamber above water in the interior chamber to pressurize the container; and electric control means, responsive to the water level sensor means, the output signal from the pressure sensor means, and the flush start means, for controlling the stopper moving means and the air compressor to fill the interior chamber with water, to pressurize the container to a predetermined pressure level and to discharge the water under pressure through the water outlet to a toilet bowl.

15. The pressurized container apparatus of claim 14 wherein the means for delivering water comprises:

a solenoid operated valve having a plurality of pairs of ports, a first pair of ports being connected to the water delivery conduit and the interior chamber of the container and a second pair of ports connected between the interior chamber of the container and atmosphere;

the valve including a plunger movable between a first and a second position, the plunger, when in the first position, blocking fluid flow through the first and second pair of ports and, when in a second position, disposing the first pair of ports in fluid flow communication between the water delivery conduit and the interior chamber of the container for the flow of water into the interior chamber and disposing the second pair of ports in fluid flow communication between the interior chamber and atmosphere for venting the interior chamber.

16. The pressurized container apparatus of claim 14 further comprising:

pressure relief means, mounted in communication with the interior chamber of the container, for relieving pressure within the interior chamber at a predetermined pressure within the interior chamber.

17. The pressurized container apparatus of claim 14 wherein the stopper moving means comprises:

an electrically operable solenoid having a movable plunger;

a stopper sized to sealingly close the water outlet in the container; and a flexible member connected to the stopper and the plunger of the solenoid.

18. The pressurized container apparatus of claim 14 wherein the control means comprises a microprocessor operating a stored control program.

19. The pressurized container apparatus of claim 15 wherein:

the pressurizable container includes a side wall having first and second ends, the first end surrounding an open top end of the container, a top sealingly closing the open top end of the container, the side wall converging at the second end into a narrow throat portion forming the water outlet.

20. The pressurized container apparatus of claim 15 further comprising:

a hollow tank mountable on a toilet bowl, the pressurizable container adapted to be mounted in the tank.

21. The pressurized container apparatus of claim 20 wherein the tank and the pressurizable container are integrally formed as a one piece unitary member.

22. The pressurized container apparatus of claim 21 wherein the tank and the pressurizable container are formed of a molded plastic.

23. The pressurized container apparatus of claim 21 wherein:

the tank has a closable top, exterior side walls, a bottom wall contiguous with the exterior side walls, and an interior wall portion; and the container includes a side wall converging at a lower end portion into a narrow throat section forming the water outlet;

the interior wall of the tank and the side wall of the container being formed as continuous unitary members.

24. The pressurized container apparatus of claim 15 further comprising:

a water trap disposed near a lower end of and connected to a toilet bowl; and a conduit adapted to be connected in fluid flow communication between the means for delivering water and the water trap for supplying water to the trap.

25. A pressurized flushing toilet comprising:

a toilet bowl having a water inlet and a water outlet;

a water trap disposed near a lower end of and connected to the toilet bowl;

a closed pressurizable container having an interior chamber with a water inlet and a water outlet connectible in fluid flow communication with the water inlet of the toilet bowl;

stopper means for releasably closing the water outlet in the container;

means, connected to the stopper means, for moving the stopper means between a first position closing the water outlet and a second position opening the water outlet for the flow of water through the water outlet to a toilet bowl;

means, connected to a water delivery conduit and the water inlet of the container, for selectively delivering water to the interior chamber in the container;

an air compressor, disposed in communication with the interior chamber of the container, for supplying compressed air to the interior chamber above water in the interior chamber to pressurize the container; and electric control means for controlling the stopper moving means and the air compressor to fill the interior chamber with water, to pressurize the container to a predetermined pressure level and to discharge the water under pressure through the water outlet to a toilet bowl.

26. The toilet of claim 25 wherein the means for delivering water comprises:

a solenoid operated valve having a plurality of pairs of ports, a first pair of ports being connected to the water delivery conduit and the interior chamber of the container and a second pair of ports connected between the interior chamber of the container and atmosphere;

the valve including a plunger movable between a first and a second position, the plunger, when in the first position, blocking fluid flow through the first and second pair of ports and, when in a second position, disposing the first pair of ports in fluid flow communication between the water delivery conduit and the interior chamber of the container for the flow of water into the interior chamber and disposing the second pair of ports in fluid flow communication between the interior chamber and atmosphere for venting the interior chamber.

27. The toilet of claim 25 further comprising:

pressure relief means, mounted in communication with the interior chamber of the container, for relieving pressure within the interior chamber at a predetermined pressure within the interior chamber.

28. The toilet of claim 25 wherein the stopper moving means comprises:

an electrically operable solenoid having a movable plunger;

a stopper sized to sealingly close the water outlet in the container; and a flexible member connected to the stopper and the plunger of the solenoid.

29. The toilet of claim 25 wherein the control means comprises a microprocessor operating a stored control program.

30. The toilet of claim 25 further comprising:

water level sensor means, mounted in the interior chamber of the container, for detecting a predetermined level of water in the interior chamber.

31. The toilet of claim 25 further comprising means for sensing the pressure within the interior chamber of the container, the pressure sensing means supplying an output signal to the control means upon detecting a predetermined pressure within the interior chamber.

32. The toilet of claim 25 wherein:

the pressurizable container includes a side wall having first and second ends, the first end surrounding an open top end of the container, a top sealingly closing the open top end of the container, the side wall converging at the second end into a narrow throat portion forming the water outlet.

33. The toilet of claim 25 further comprising:

a hollow tank mountable on a toilet bowl, the pressurizable container being mounted in the tank.

34. The toilet of claim 25 further comprising:

a conduit connected in fluid flow communication between the means for delivering water and the water trap for supplying water to the trap.

35. A pressurized flushing toilet comprising a toilet bowl having a water inlet and a water outlet;

a water trap disposed near a lower end of and connected to the toilet bowl;

a hollow tank mounted on the toilet bowl;

a closed pressurizable container having an interior chamber with a water inlet and a water outlet connectible in fluid flow communication with the water inlet of the toilet bowl;

the pressurizable container mounted in and integrally formed as a one piece unitary member with the tank;

stopper means for releasably closing the water outlet in the container;

means, connected to the stopper means, for moving the stopper means between a first position closing the water outlet and a second position opening the water outlet for the flow of water through the water outlet to a toilet bowl;

means connected to a water delivery conduit and the water inlet of the container, for selectively delivering water to the interior chamber in the container;

means, disposed in communication with the interior chamber of the container, for pressurizing air in the interior chamber above water in the interior chamber; and electric control means for controlling the stopper moving means and the pressurizing means to fill the interior chamber with water, to pressurize the air above the water to a predetermined pressure level and to discharge the water under pressure through the water outlet to a toilet bowl.

36. The toilet of claim 35 wherein the tank and the pressurizable container are formed of a molded plastic.

37. The toilet of claim 35 wherein:

the tank has a closable top, exterior side walls, a bottom wall contiguous with the exterior side walls, and an interior wall portion; and the container includes a side wall converging at a lower end portion into a narrow throat section forming the water outlet;

the interior wall of the tank and the side wall of the container being formed as continuous unitary members.

38. A pressurized flushing toilet comprising:

a toilet bowl having an inlet and an outlet;

a water trap disposed near a lower end of and connected to the toilet bowl;

a closed pressurizable container having an interior chamber with a water inlet and a water outlet connectible in fluid flow communication with the inlet of the toilet bowl;

stopper means for releasably closing the water outlet in the container;

means, connected to the stopper means, for moving the stopper means between a first position closing the water outlet and a second position opening the water outlet for the flow of water through the water outlet to a toilet bowl;

means, connected to a water delivery conduit and the water inlet of the container, for selectively delivering water to the interior chamber in the container;

* * * * *

UNITED STATES PATENT AND TRADEMARK OFFICE

CERTIFICATE OF CORRECTION

PATENT NO. : 5,363,513

DATED : November 15, 1994

INVENTOR(S) : Karl Blankenburg

It is certified that error appears in the above-identified patent and that said Letters Patent is hereby corrected as shown below:

Insert after column 14, line 45:

-- a conduit connected in fluid flow communication between the means for delivering water and the water trap for supplying water to the trap;

water level sensor means, mounted in the interior chamber of the container, for detecting a predetermined level of water in the interior chamber;

means for sensing the pressure within the interior chamber of the container, the pressure sensing means supplying an output signal upon detecting a predetermined pressure within the interior chamber;

flush start means, accessible exteriorly of the container, for generating a flush start signal when actuated;

an air compressor, disposed in communication with the interior chamber of the container, for supplying compressed air to the interior chamber above water in the interior chamber to pressurize the container; and

UNITED STATES PATENT AND TRADEMARK OFFICE

CERTIFICATE OF CORRECTION

PATENT NO. : 5,363,513

DATED : November 15, 1994

INVENTOR(S) : Karl Blankenburg

It is certified that error appears in the above-indentified patent and that said Letters Patent is hereby corrected as shown below:

electric control means, responsive to the water level sensor means, the pressure sensor means, and the flush start means, for controlling the stopper moving means and the air compressor to fill the interior chamber with water, to pressurize the container to a predetermined pressure level and to discharge the water under pressure through the water outlet to a toilet bowl.--

Signed and Sealed this

Seventh Day of February, 1995

*Attest:*

Bruce Lehman

BRUCE LEHMAN

*Attesting Officer*

*Commissioner of Patents and Trademarks*